US005655430A

United States Patent [19]

Richards

[11] Patent Number: 5,655,430

[45] Date of Patent: Aug. 12, 1997

[54] HELM PUMP

[75] Inventor: Paul D. Richards, Nokomis, Fla.

[73] Assignee: IMO Industries, Inc., Sarasota, Fla.

[21] Appl. No.: 494,393

[22] Filed: Jun. 26, 1995

[51] Int. Cl.[6] ..... F01B 13/04

[52] U.S. Cl. ..... 92/57; 92/71; 92/135; 417/269

[58] Field of Search ..... 92/57, 71, 12.2, 92/135; 417/269; 91/499

[56] References Cited

U.S. PATENT DOCUMENTS

| | | | |
|---|---|---|---|
| 1,423,291 | 7/1922 | Aikman . | |
| 1,517,777 | 12/1924 | Flint . | |
| 1,589,472 | 6/1926 | Huntley . | |
| 1,600,385 | 9/1926 | Aikman . | |
| 2,299,234 | 10/1942 | Snader et al. . | |
| 2,331,694 | 10/1943 | Jeffrey | 92/135 |
| 2,473,336 | 6/1949 | Ifield | 92/71 |
| 2,915,985 | 12/1959 | Budzich . | |
| 3,006,284 | 10/1961 | Pitt et al. . | |
| 3,296,976 | 1/1967 | Soeters | 417/269 |
| 3,418,942 | 12/1968 | Partos | 417/269 |
| 3,435,774 | 4/1969 | Parrett . | |
| 3,482,525 | 12/1969 | Di Bartolo et al. | 92/135 |
| 3,620,649 | 11/1971 | Cary | 92/57 |
| 3,712,758 | 1/1973 | Lech et al. | 417/214 |
| 3,744,377 | 7/1973 | Lauck | 91/499 |
| 4,741,251 | 5/1988 | Hayashi et al. . | |
| 4,744,288 | 5/1988 | Mauch | 92/57 |
| 4,898,077 | 2/1990 | McBeth | 91/505 |
| 5,058,485 | 10/1991 | Cardillo | 91/499 |

*Primary Examiner*—Thomas E. Denion
*Attorney, Agent, or Firm*—Jansson & Shupe, Ltd.

[57] ABSTRACT

A hydraulic helm pump used for vessel steering has a housing, a barrel rotating in the housing, and one or more cylindrical pistons reciprocating in the barrel. The barrel has a separate abutment surface at the end of each piston bore and spaced from each respective piston. The pistons are solid, not hollow. A compression spring is interposed between each respective piston and the abutment surface and the spring outside diameter is about equal to the maximum diameter of the piston. When each piston is in its forward position, its forward end is very close to the abutment surface, thereby reducing unswept volume. And each piston return spring occupies most of the remaining otherwise-unswept volume between the piston and its bore. The pistons are random-fitted to their bores and include resilient piston-and-bore seal members.

13 Claims, 2 Drawing Sheets

FIG. 3
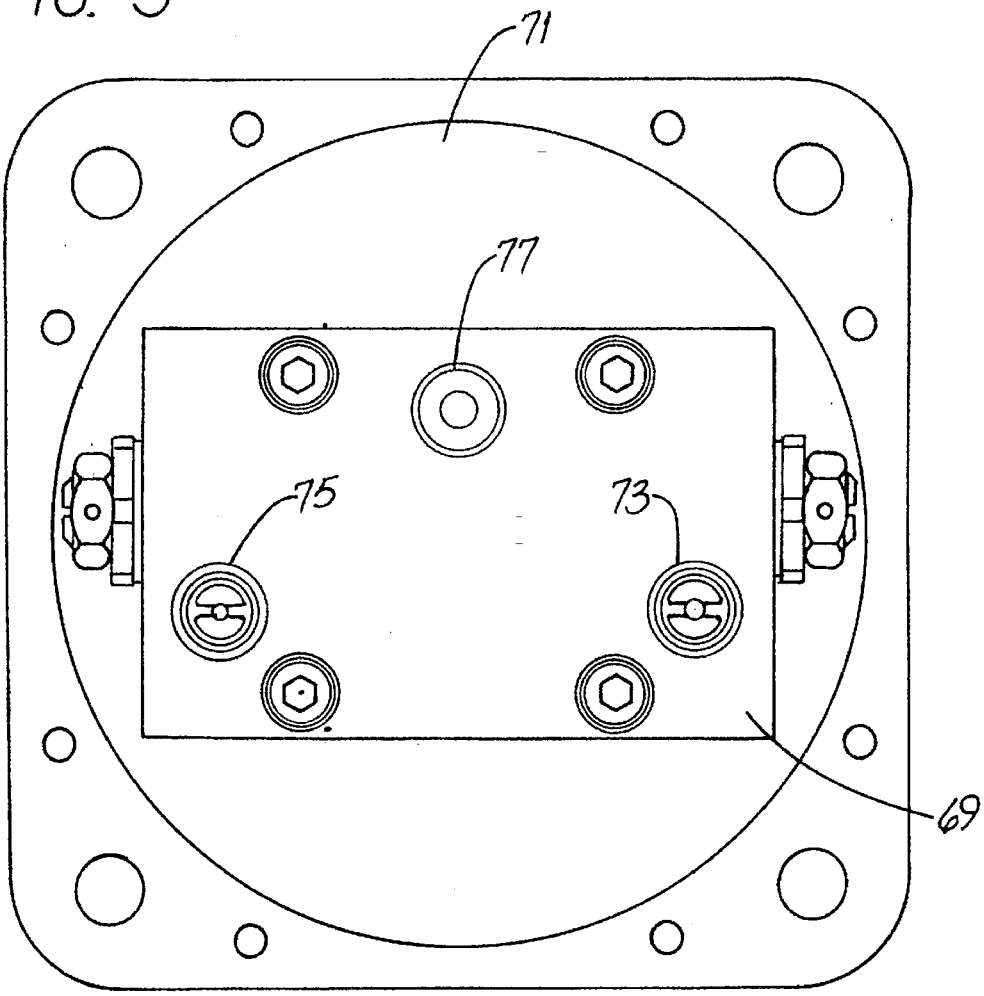
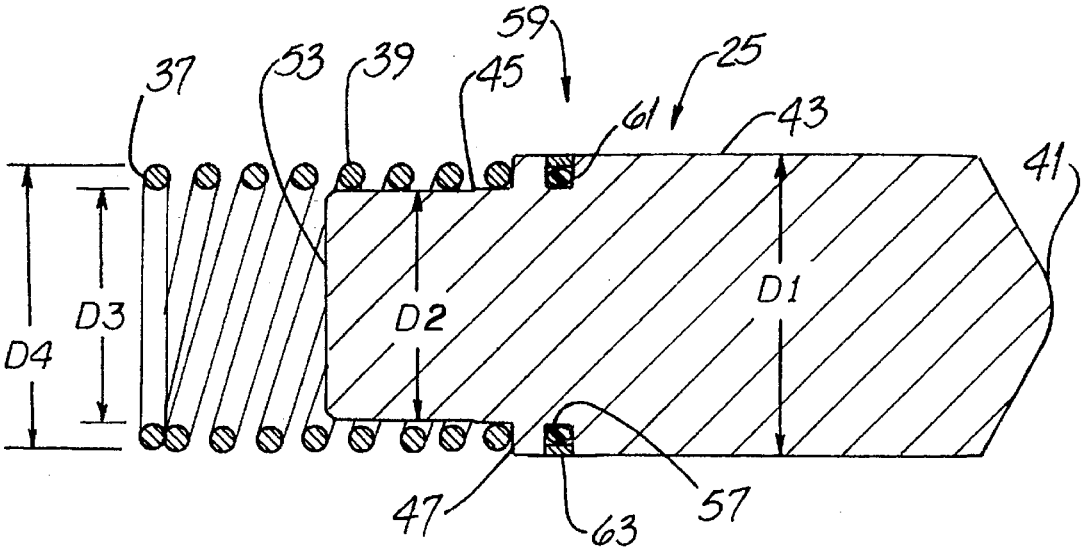
FIG. 2

HELM PUMP

FIELD OF THE INVENTION

This invention relates generally to expansible chamber devices and, more particularly, to pumps.

BACKGROUND OF THE INVENTION

Some motorized vessels, e.g., a small open boat equipped with low-horsepower (e.g., 3 HP) outboard motor, is steered simply by manipulating the motor tiller. Such manipulation changes the angular position of the propeller and of a rudder-like piece adjacent to the propeller.

Motors of boats equipped with higher-horsepower outboard motors, the propeller-and-rudder drive of boats having inboard-outboard drives (often referred to as "I/O" drives) and the rudder of boats having inboard drives all exhibit higher tiller arm torque or high rudder torque (as the case may be), especially when the boat is turned. Cable-type mechanical systems have been used for steering such boats but the "steering force feedback" from the rudder to the hands of the operator is objectionable. And in a boat with two helms (two locations from which the boat can be operated), cable systems are difficult to install.

Hydraulic steering systems, in wide use, overcome the objectionable aspects of cable systems. Hydraulic systems include check valves preventing force feedback to the operator when the helm wheel is not being turned. And such hydraulic systems are quite easy to install and maintain in dual-helm boats.

In a hydraulic steering system, pressurized fluid is provided by a hydraulic pump attached to and rotated by the helm wheel used to steer the vessel. In other words, the human "helmsperson" is the pump "prime mover" and pumps of this type are known as helm pumps.

In a typical helm pump, there is an angled swash plate mounted stationary in the housing. The pump barrel has axial pistons reciprocating in piston bores in the barrel and each piston is in contact with the swash plate.

During the suction portion of a piston reciprocating "cycle," each piston is urged in one direction, usually rearward toward the helm wheel, by a spring and thereby draws fluid into the piston bore. During the pressure portion of the piston cycle, the piston is urged forward by its contact with the swash plate and delivers fluid to the steering circuit. For each revolution of the pump barrel (usually corresponding to a single revolution of the helm wheel), each piston makes one complete cycle comprised of one forward and one rearward motion component.

In a helm pump of the aforedescribed type, many design considerations involve the piston return springs. Such springs function in the following way.

Each piston is caused to move rearwardly by its spring and "draws" a slight vacuum in its bore so that fluid flows into such bore to be later pumped out. During this suction part of the cycle, it is important that each piston be kept in contact with the swash plate. A piston which cavitates significantly may separate from the swash plate and pump damage and/or improper steering may result.

To help overcome the tendency to cavitate during suction, earlier designers of helm pumps have used a relatively long, high-force spring to keep the piston in contact with the swash plate. The adverse implications for pump length (resulting from using a long spring) have been addressed by using a hollow piston. One end of the long piston spring is inserted into the piston interior cavity. Hollow pistons are more difficult to manufacture than solid pistons and give rise to manufacturing costs which, in view of the invention, are unnecessary.

And using a long spring and hollow piston increases the pump "unswept volume," i.e., the volume of fluid which is not expelled from the piston on each pumping cycle. Such unswept volume is that in the hollow piston and that between the piston end and the end of the barrel.

And, in turn, the use of a hollow piston gives rise to other design difficulties. When a hollow piston is used, the remaining wall thickness is insufficient to permit machining a seal groove and using a resilient seal in such groove and around the piston diameter. This problem could be overcome by making the piston diameter quite large but the resulting heavier, higher-drag piston may require an even higher-force spring.

Another approach (and the one commonly used) is to employ a metal-to-metal seal by "select-fitting" each piston to its bore. When select-fitting pistons to bores, the diameter of each bore is measured and pistons are segregated into groups, each according to a slightly different range of piston diameters. Then a piston is selected from a particular group to fit into a particular bore. Such selection is made so that the "clearance" between the piston and bore, i.e., the difference in diameter between a piston and its bore, is sufficiently small that leakage is maintained at an acceptably-low level. Select-fitting pistons to bores requires that both be precisely round within very close tolerances.

It is apparent that select-fitting is an expensive, time-consuming manufacturing process. And field repair is made much more expensive in that, in all likelihood, the barrel and pistons must be replaced as a set even though only the replacement of, say, a single piston is indicated.

Yet another disadvantage of prior art helm pumps involves system "bleeding." Bleeding is a procedure used to remove system air after initial installation or later service. Bleeding is necessary since air causes the system to feel "spongy" during steering. It is a known practice to return the often-air-laden fluid to the pump at a location where the pistons draw such air-laden fluid into the piston bore. With such arrangement, it is more difficult to remove all of the air from the system.

A new helm pump which addresses and overcomes some of the disadvantages of prior art helm pumps would be an important advance in the art.

OBJECTS OF THE INVENTION

It is an object of the invention to provide a new pump which overcomes some of the problems and shortcomings of the prior art.

Another object of the invention is to provide a new pump which results in a pump having a reasonable length.

Another object of the invention is to provide a new pump which reduces overall spring-piston length.

Yet another object of the invention is to provide a new pump which simplifies field repairs.

Another object of the invention is to provide a new pump which obviates the need to select-fit pistons to the pump barrel.

Another object of the invention is to provide a new pump which avoids the use of metal-to-metal seals between each piston and the respective bore.

Still another object of the invention is to provide a new pump which has a reduced unswept volume.

Another object of the invention is to provide a new pump which facilitates easier system bleeding.

Another object of the invention is to provide a new pump wherein during bleeding the pistons draw from a volume of fluid which is substantially free of air. How these and other objects are accomplished will become more apparent from the following descriptions and from the drawing.

SUMMARY OF THE INVENTION

The invention involves a pump of the type having a housing, a barrel rotating in the housing about an axis of rotation, an angled swashplate in the housing and one or more (usually several) generally cylindrical pistons, each reciprocating in a separate bore in the barrel. In an aspect of the invention, the barrel has an abutment surface at the front of the bore and spaced somewhat from the piston. A cylindrical compression spring is interposed between the piston and the abutment surface and such spring has an outside diameter. Such spring is about equal to the piston outside or first diameter so that such spring is retained generally concentric with the bore. That is, the maximum outside diameter of the piston and the outside diameter of the spring are about equal.

In a more specific embodiment, the piston includes a first portion adjacent to the swash plate and having the first or maximum outside diameter. A second portion of the piston (with a reduced, second diameter less than the first diameter) is spaced from the swash plate. One end of the spring overlaps and engages such second portion and since the second or smaller diameter of the piston is only slightly less than the inside diameter of the spring, the spring is maintained generally coaxial with the piston and would be so even if there was substantial disparity between the spring outside diameter and the bore diameter.

The new pump obviates the need to use pistons select-fitted to their bores in order to attain acceptably-low leakage. Rather than use select-fit pistons to reduce leakage, the new pump has a seal member between the first portion and the bore. Leakage between the piston and the bore is thereby substantially prevented. In a specific embodiment, the first larger-diameter portion of the piston has a circumferential groove formed in it and the seal member is in the groove. Such seal member includes a resilient seal and a backup slipper ring.

The new pump is configured as a helm pump for steering a boat. Typically, such a pump is driven by rotating the boat steering wheel to which the pump is attached. Clearly, such rotation is at very low speed. In recognition of that fact (and of the more subtle fact that the effect of piston mass is negligible at such low speed), the piston is a solid rather than a hollow piston. In other words, it is substantially free of interior spaces or cavities. This significantly reduces the unswept volume of the piston below such volume as might be experienced in, say, the pump of the Pitt et al. patent mentioned above.

And that is not all. There is another feature which helps reduce unswept volume. The piston has a distal end away from the swash plate and reciprocates between a forward position and a rearward position. When the piston is in the forward position, the distal end is closely proximate to the abutment surface. That is, there is very little space between the piston and such abutment surface at that forward piston position and that feature also reduces the unswept volume of the piston.

In yet another aspect of the invention, the piston has a shoulder between its first, larger-diameter portion and its second, smaller-diameter portion. The spring, which is interposed between the shoulder and the abutment surface, has a collapsed or "solid" height. When the piston is in the forward position, the distance between the abutment surface and the shoulder is only slightly greater than the collapsed height of the spring. Since there is very little space between the piston and the abutment surface when the piston is in the forward position and since the spring occupies most of the remaining bore space between the barrel and the piston, the unswept volume of the piston is further reduced.

In another aspect of the invention, the pump housing has a fluid-containing cavity and at least a portion of such cavity is below the axis of rotation when the pump is mounted in the vessel. The piston is connected by a passage to draw fluid from such portion which is substantially free of air. This feature is particularly helpful when bleeding the system after initial installation or following maintenance.

Other details regarding the invention are set forth in the following detailed description and in the drawing.

BRIEF DESCRIPTION OF THE DRAWING

FIG. 2 is a cross-sectional side elevation view of a piston and piston return spring of the pump of FIG. 1.

FIG. 3 is an elevation view of the pump of FIG. 1 taken along the viewing plane 3—3 thereof.

DETAILED DESCRIPTION OF PREFERRED EMBODIMENTS

Figure 1:
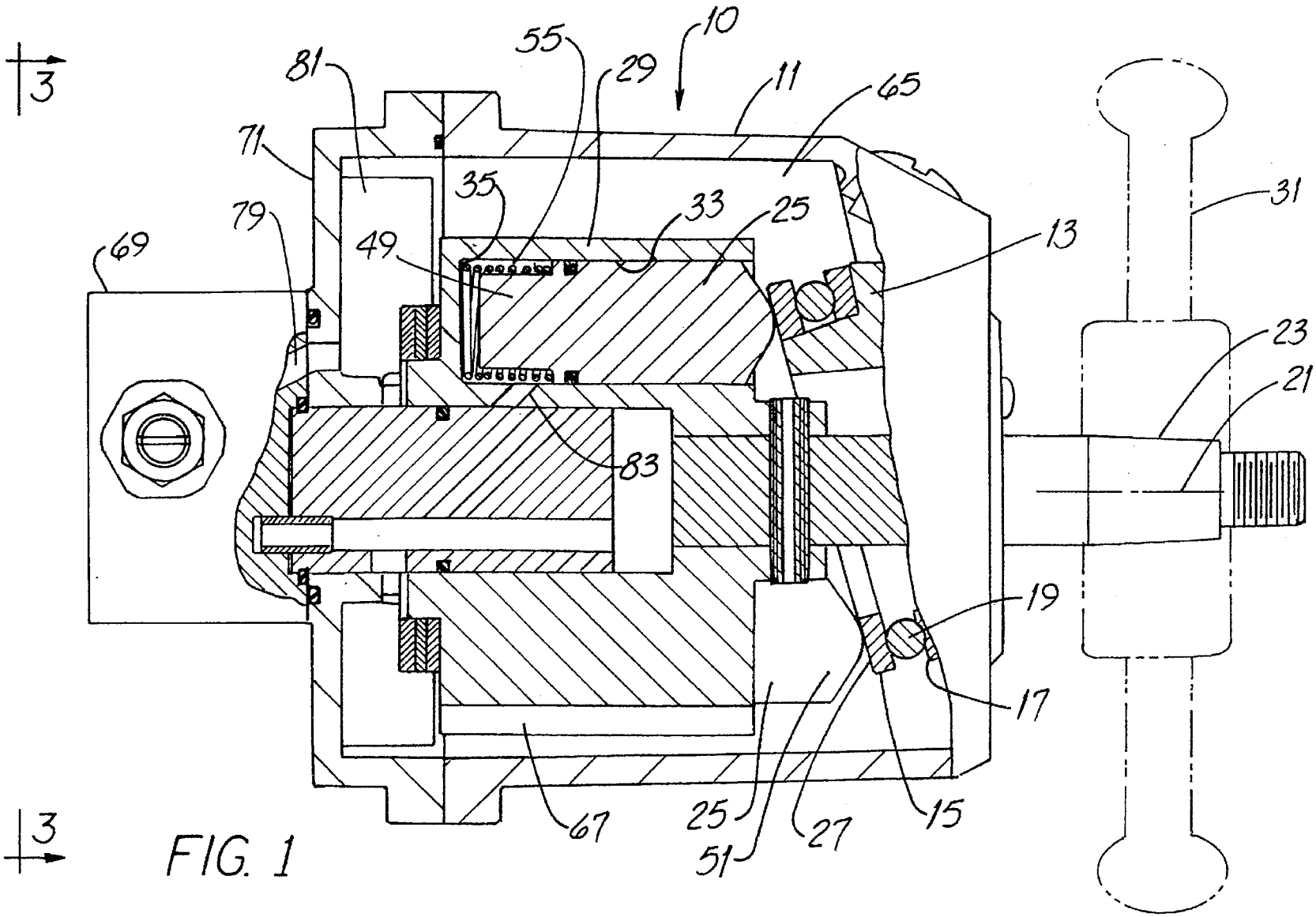
FIG. 1 is a partial cross-sectional side elevation view of the new pump. Parts are broken away and a vessel steering wheel is shown in phantom outline.

Referring first to FIGS. 1 and 2, the new pump 10 includes a housing 11 and a stationary swash plate block 13 at the rear of such housing 11. A pair of annular, generally-flat swash plates 15, 17 are supported by the block 13 and spaced from one another by bearings 19. So configured and arranged, the forward swash plate 15 can rotate about the longitudinal axis of rotation 21 of the drive shaft 23 as such plate 15 is urged along by friction with the pistons 25. It is to be appreciated that the flat forward face 27 of the forward swash plate 15 defines an acute angle with the axis 21.

The pump 10 also includes a barrel 29 which is coupled to, concentric with and rotates with the drive shaft 23. The shaft 23 is connected to the vessel steering wheel 31. The barrel 29 has a plurality of cylindrical piston bores 33 formed therein, such bores 33 being generally parallel to one another and to the axis 21. In a specific embodiment, there are seven such bores 33, each spaced about 51° from adjacent bores 33. But a pump 10 incorporating the invention could have one or more such bores 33.

At its forward end, each bore 33 terminates in a generally flat abutment surface 35, the plane of which is generally normal to the axis 21. As will become apparent, the forward end 37 of each piston return spring 39 (a coiled compression spring) bears against the abutment surface 35 of a respective piston bore 33 and the forward end of each piston 25 is always spaced at least slightly from the abutment surface 35 of its bore 33.

Each piston 25 has a rear bearing surface 41 which contacts and slides along the swash plate 15 as the barrel 29 is rotated. It is apparent from the foregoing that as such barrel 29 is rotated, the angularity of the swash plate 15 causes each piston 25 to move forward and rearward in its bore 33.

The pistons 25 may be said to have a "stepped" configuration in that each piston 25 has a first portion 43 adjacent to the swash plate 15 and having a first diameter D1. Each piston 25 also has a second portion 45 spaced from the swash plate 15 and having a second diameter D2 which is less than the first diameter. Preferably, the difference between the diameters D1 and D2 is about equal to twice the diameter of the wire from which the spring 39 is made.

An annular shoulder 47 is between the portions 43, 45 and forms that surface against which the rear end of the piston spring 39 abuts. The spring 39 has an inside diameter D3 and the diameter D2 of the second portion 45 of the piston 25 is only slightly less than the inside diameter D3 of the spring 39. When the pump 10 is assembled, the spring 39 engages and overlaps the second portion 45 and the spring 39 is thereby maintained generally coaxial with its respective piston 25.

In a highly preferred embodiment, each piston 25 is a solid piston rather than hollow. Putting it another way, the pistons 25 are free of interior cavities and this feature significantly reduces the unswept volume of each piston 25 and of the pump 10. And the new pump 10 also has another feature which aids in reducing such unswept volume. As the shaft 23 and barrel 29 are rotated, each piston 25 reciprocates between a forward position, shown at location 49, and a rearward position shown at location 51. When a piston 25 is in the forward position 49, its distal end 53 is very close to the abutment surface 35 terminating the piston bore 33. Thus, the volume of fluid between the piston distal end 53 and the abutment surface 35 is quite small.

There is yet another feature which reduces unswept volume. All coil springs 39 extend along a straight axis and have a so-called collapsed or solid height. As shown in FIG. 1, the spring is very near but not at its solid height (note the slight space between spring "turns") when its piston 25 is in the forwardmost position. The reason such spring 39 is not at its solid height is that when a piston 25 is at its forwardmost position, the distance between the abutment surface 35 and the piston shoulder 47 is slightly greater than the solid height of the spring 39. Therefore, the cup-shaped cavity 55 defined by the abutment surface 35, the piston bore 33 and the second portion 45 of the piston 25 is substantially filled by the spring 39. Such spring 39 displaces a volume of fluid that would otherwise be unswept.

Referring particularly to FIG. 2, the first portion 43 of each piston 25 has a circumferential groove 57 formed therein. There is a seal member 59 in the groove 57 and such seal member 59 includes a resilient "O" ring seal 61 and an annular backup slipper ring 63. A suitable material for such slipper ring 63 is 15% glass-filled Teflon®.

Given the ability to use such a seal member 59, the clearance between the outside diameter D1 of the piston first portion 43 and the wall of the bore 33 may be relatively generous. The seal member 59 provides a highly-effective, substantially leak-tight seal between the bore 33 and the piston 25 without the need to select-fit pistons 25 to their bores 33.

Referring particularly to FIG. 1, the housing 11 has a fluid-containing cavity 65, at least a portion 67 of which is below the axis of rotation 21 when the pump 10 is mounted in a vessel. In fact, substantially all of such cavity 65 is filled with fluid during pump operation.

Referring next to FIGS. 1 and 3, a highly preferred embodiment of the new helm pump 10 includes a valve 69 manifolded to the pump cover 71. Such valve 69 has an opening 73 from which fluid is delivered from the pump 10 for steering to port, another opening 75 from which fluid is delivered from the pump 10 for steering to starboard and a passage 79 to which a fluid return line is connected. (The opening 77 is used in a two-reservoir system to couple such reservoirs in flow communication with one another.)

The valve 69 is configured so that during system bleeding, fluid is returned along the passage 79 to that part 81 of the cavity 65 which is elevated above the bottom portion 67 of the cavity 65. During bleeding, fluid being returned to the part 81 of the cavity 65 often has air bubbles entrained therein. Such bubbles naturally rise to the top of the fluid in the cavity 65.

The bottom portion 67 of the cavity 65 is in flow communication with an annular passage 83 which opens into each piston bore 33. And because such portion 67 is at or near the lowermost part of the housing 11, fluid in such portion 67 is substantially free of air since air bubbles rise upwardly away from it. This configuration helps assure that fluid being delivered by the pistons 25 to the steering system is substantially free of air.

As used in this specification, directional terms such as "forward," "rearward," "rear" and the like are referenced to the vessel in which the pump 10 is mounted and are merely for convenience in description. For example, the pump drive shaft 23 protrudes from the rear of the pump 10, i.e., from that portion of the pump 10 toward the rear or stern of the vessel.

While the principles of the invention have been shown and described in conjunction with a few specific embodiments, it is to be understood clearly that such embodiments are exemplary and are not limiting.

What is claimed is:

1. In a helm pump for steering a boat, such pump having (a) a housing, (b) a barrel rotating in the housing, and (c) a piston reciprocating in the barrel and having a tapered distal end and a generally cylindrical exterior surface extending away from such distal end, the improvement wherein:

the barrel has an abutment surface spaced from the piston;

a cylindrical compression spring is interposed between the piston and the abutment surface;

the exterior surface of the piston includes (a) a cylindrical first portion having a diameter, and (b) a second portion having a diameter less than the diameter of the first portion;

the compression spring has an inside diameter and an outside diameter;

the diameter of the first portion is about equal to the outside diameter of the spring; and the diameter of the second portion is less than the inside diameter of the spring.

2. The pump of claim 1 including an angled swash plate and wherein;

the first portion is between the swash plate and the second portion; and the spring engages the second portion.

3. The pump of claim 2 wherein:

the spring overlaps the second portion; and the second diameter is only slightly less than the inside diameter, whereby the spring is maintained generally coaxial with the piston.

4. The pump of claim 1 including an angled swash plate and wherein the piston reciprocates in a barrel bore and wherein:

the first portion is made of a hard, rigid material; and a resilient seal member is between the first portion and the bore, whereby leakage between the piston and the bore is substantially prevented.

5. The pump of claim 4 wherein:

the first portion has a circumferential groove formed therein; and the seal member is in the groove.

6. The pump of claim 1 wherein the piston is of one-piece construction and is substantially free of interior cavities, whereby the unswept volume of the piston is reduced.

7. The pump of claim 1 including an angled swash plate, and wherein:

the compression spring is made of wire having a wire diameter;

the piston reciprocates between a forward position and a rearward position;

the piston has a distal end away from the swash plate; and the distal end is spaced from the abutment surface by a distance not greater than about three times the wire diameter when the piston is in the forward position, whereby the unswept volume of the piston is reduced.

8. The pump of claim 1 wherein:

the piston has distal and proximal ends and an exterior shoulder intermediate the ends;

the piston reciprocates between a forward position and a rearward position;

the spring has a collapsed height and is interposed between the shoulder and the abutment surface; and when the piston is in the forward position, the distance between the abutment surface and the shoulder is slightly greater than the collapsed height of the spring, whereby the unswept volume of the piston is reduced.

9. The pump of claim 1 including an axis of rotation and wherein:

the housing includes a fluid-containing cavity, at least a portion of which is below the axis of rotation; and the piston is connected by a passage to draw fluid from such portion which is substantially free of air.

10. In a helm pump for steering a boat and having (a) a housing, (b) a barrel rotating in the housing, (c) a plurality of generally cylindrical pistons reciprocating in the barrel, and (d) a swash plate, and wherein the pistons extend in the same direction away from the swash plate, the improvement wherein with respect to at least one of the pistons:

the barrel has an abutment surface spaced from the said one of the pistons;

a generally cylindrical compression spring is interposed between the said one of the pistons and the abutment surface;

the spring is around the said one of the pistons; and the said one of the pistons is substantially free of interior cavities, whereby the unswept volume of the said one of the pistons is reduced.

11. The pump of claim 10 including a swash plate and a plurality of pistons reciprocating in the barrel and wherein:

the swash plate has a single surface toward the pistons; and all of the pistons contact the single surface.

12. The pump of claim 11 wherein at least one of the pistons includes:

a first portion adjacent to the swash plate and having a first diameter;

a second portion spaced from the swash plate and having a second diameter less than the first diameter, and wherein:

the first portion and the second portion define an exterior annular shoulder therebetween.

13. The pump of claim 10 including an axis of rotation and wherein:

the housing includes a fluid-containing cavity, at least a portion of which is below the axis of rotation; and the piston is connected by a passage to draw fluid from such portion which is substantially free of air.

* * * * *